US009255374B2

(12) United States Patent
Elmbo

(10) Patent No.: US 9,255,374 B2
(45) **Date of Patent: *Feb. 9, 2016**

(54) ICEBREAKING VESSEL AND METHOD OF BREAKING ICE

(75) Inventor: Niels Peter Elmbo, Kokkedal (DK)

(73) Assignee: MAERSK SUPPLY SERVICE A/S, Copenhagen K (DK)

( * ) Notice: Subject to any disclaimer, the term of this patent is extended or adjusted under 35 U.S.C. 154(b) by 408 days.

This patent is subject to a terminal disclaimer.

(21) Appl. No.: 13/638,350

(22) PCT Filed: Mar. 31, 2011

(86) PCT No.: PCT/DK2011/050104
§ 371 (c)(1),
(2), (4) Date: Dec. 7, 2012

(87) PCT Pub. No.: WO2011/120527

PCT Pub. Date: Oct. 6, 2011

(65) Prior Publication Data

US 2013/0074753 A1 Mar. 28, 2013

Related U.S. Application Data

(60) Provisional application No. 61/319,474, filed on Mar. 31, 2010, provisional application No. 61/409,677, filed on Nov. 3, 2010.

(30) Foreign Application Priority Data

Mar. 31, 2010 (DK) ..... 2010 70136
Oct. 29, 2010 (DK) ..... 2010 70465

(51) Int. Cl.
*B63B 21/50* (2006.01)
*B63B 35/08* (2006.01)
(Continued)

(52) U.S. Cl.
CPC ..... *E02B 15/02* (2013.01); *B63B 21/16* (2013.01); *B63B 21/50* (2013.01); *B63B 35/083* (2013.01);
(Continued)

(58) Field of Classification Search
CPC ..... B63B 21/50; B63B 35/08; B63B 35/083; B63B 35/086; B63B 35/10; B63B 35/12; B63B 21/16; B63H 5/00; B63H 5/08; B63H 15/00; B63H 2005/1254; E02B 15/02
USPC ..... 114/40–43, 293, 294; 405/217
See application file for complete search history.

(56) References Cited

U.S. PATENT DOCUMENTS 704,155 A * 7/1902 Walters ..... 114/181
3,656,449 A 4/1972 Mead
(Continued)

FOREIGN PATENT DOCUMENTS

CA 1232768 A 2/1988
CA 2684772 A1 11/2008
(Continued)

OTHER PUBLICATIONS

International Search Report for PCT/DK2011/50104, mailed Sep. 14, 2011.
(Continued)

*Primary Examiner* — Ajay Vasudeva
(74) *Attorney, Agent, or Firm* — Brinks Gilson & Lione

(57) ABSTRACT

To keep the water around an off-shore installation (1) free from a harmful impact of ice, a vessel (5) is used to deploy an anchor (6) in a position at a distance from the off-shore installation (1) and in a direction which, seen from the off-shore installation (1), is substantially in parallel with the direction of movement (P) of the ice. By means of the machinery of the vessel, which preferably comprises azimuth propellers, the direction of the anchor line is adjusted and so is the orientation of the vessel relative to the anchor line to the effect that then propellers can be used to crush and dispose of the ice without using energy to hold the vessel up against the pressure of the ice.

15 Claims, 10 Drawing Sheets

(51) Int. Cl.

| | |
|---|---|
| ***B63B 35/12*** | (2006.01) |
| ***B63H 15/00*** | (2006.01) |
| ***B63H 25/42*** | (2006.01) |
| ***E02B 15/02*** | (2006.01) |
| ***B63B 21/16*** | (2006.01) |
| *B63H 5/08* | (2006.01) |
| *B63H 5/125* | (2006.01) |

(52) U.S. Cl.
CPC ..... *B63H 15/00* (2013.01); *B63H 25/42* (2013.01); *B63H 5/08* (2013.01); *B63H 2005/1254* (2013.01)

(56) References Cited

U.S. PATENT DOCUMENTS

| | | | | |
|---|---|---|---|---|
| 3,837,311 | A | 9/1974 | Lea, Jr. | |
| 3,872,814 | A * | 3/1975 | Rodriguez | 114/40 |
| 3,881,318 | A | 5/1975 | Galloway | |
| 3,886,882 | A | 6/1975 | Thornburg et al. | |
| 3,965,835 | A * | 6/1976 | Bennett | 114/42 |
| 4,215,952 | A | 8/1980 | Baardsen | |
| 4,547,093 | A | 10/1985 | Statham | |
| 4,596,291 | A * | 6/1986 | Makinen et al. | 175/5 |
| 4,800,831 | A * | 1/1989 | Hellmann et al. | 114/40 |
| 4,942,837 | A * | 7/1990 | Hellmann et al. | 114/40 |
| 5,224,800 | A | 7/1993 | Mogridge | |
| 5,676,083 | A * | 10/1997 | Korsgaard | 114/230.1 |
| 7,681,511 | B2 | 3/2010 | Breivik et al. | |
| 8,347,801 | B2 | 1/2013 | Denise | |
| 9,003,987 | B2 * | 4/2015 | Saarinen et al. | 114/40 |
| 9,056,658 | B2 * | 6/2015 | Elmbo | B63B 21/50 114/42 |
| 2003/0131777 | A1 | 7/2003 | Fischer | |
| 2013/0087088 | A1 | 4/2013 | Elmbo | |

FOREIGN PATENT DOCUMENTS

| | | | |
|---|---|---|---|
| FR | 2924677 | A1 | 6/2009 |
| RU | 2042568 | C1 * | 8/1995 |
| SU | 925752 | A1 * | 5/1982 |
| WO | 2007089152 | A1 | 8/2007 |
| WO | 2007136273 | A1 | 11/2007 |
| WO | 2008116964 | A1 | 10/2008 |
| WO | 2008140654 | A1 | 11/2008 |
| WO | 2009099337 | A1 | 8/2009 |
| WO | 2010103170 | A2 | 9/2010 |

OTHER PUBLICATIONS

Written Opinion for PCT/DK2011/50104, mailed Sep. 14, 2011.
International Preliminary Report on Patentability for PCT/DK2011/50104, mailed Oct. 2, 2012.
Danish office action for PA 2010 70136, Completed Nov. 12, 2010.
Danish office action for PA 2010 70154, Completed Nov. 8, 2011.
Danish office action for PA 2010 70465, Completed Sep. 14, 2011.
International Search Report for PCT/DK2011/050105, mailed Sep. 14, 2011.
Written Opinion for PCT/DK2011/050105, mailed Sep. 14, 2011.
International Type Search Report, mailed Sep. 30, 2011.
International Preliminary Report on Patentability for PCT/DK2011/050105, mailed Oct. 2, 2012.
Office Action for U.S. Appl. No. 13/077,772, mailed Jun. 19, 2013.

* cited by examiner

ICEBREAKING VESSEL AND METHOD OF BREAKING ICE

RELATED APPLICATIONS

This application claims the benefit under 35 U.S.C. §371 of International Patent Application No. PCT/DK2011/050104, having an international filing date of Mar. 31, 2011, which claims priority to Danish Patent Application No. PA 2010 70136, filed Mar. 31, 2010, U.S. Provisional Application No. 61/319,474, filed Mar. 31, 2010, Danish Patent Application No. PA 2010 70465, filed Oct. 29, 2010, and U.S. Provisional Application No. 61/409,677, filed Nov. 3, 2010, the contents of all of which are incorporated herein by reference in their entirety.

The invention relates to a vessel as set forth in the introductory part to claim 1.

The vessel is for breaking ice drifting in a predominant direction relative to an off-shore installation such as eg a drilling vessel. The ice drifts with the current, but it is also influenced by the wind.

It is very important that off-shore installations in ice-filled waters are protected against the impacts of the ice. For instance, an oil or gas platform may be concerned.

In the following description, a drilling vessel will be used as an example of an off-shore installation. Upon impact, a drilling vessel must usually not be shifted more than about 2% of the depth of the water before the drilling operation has to be discontinued, and, if it is shifted more than about 5%, the drill pipe must usually be disconnected. It is therefore to be understood that impacts from ice, in particular in shallow waters, are extremely critical. Under no circumstances should large pieces of ice be allowed to hit the drilling vessel.

It is known within the prior art to use several, typically three, powerful icebreakers that cooperate (ice management) to ensure that large chunks of ice cannot drift towards the platform or that the ice is not capable of packing around it.

Pack ice and ridged ice are the types of ice that it takes the largest amount of energy to avoid. It is assumed that by means of conventional icebreakers it may be necessary with a machine power of upwards of 60-70 Megawatt, when the ice is thick and the current is heavy. That magnitude of machine power is comparable with nuclear-powered vessels, and in view of the fact that three vessels are often used, it will be understood that it is extremely resource-demanding and cost-intensive to secure a drilling vessel against the impacts of the ice.

The object of the invention is to provide a vessel which is considerably more resource-saving than the prior art.

The object is achieved by the opening through which the anchor line travels being located below (deeper than) the propeller shaft of the vessel.

By locating the opening through which the anchor line travels outwards below sea level, it is accomplished that the anchor line is not impacted by the ice, and hence the torquing on the vessel is avoided which might otherwise occur as a consequence of the ice influencing the anchor line.

According to the prior art one would, when one tethers a vessel to an anchor, secure the anchor line to the vessel at a large distance from the natural pivot point of the vessel. Thereby one hopes that the vessel will—due to the momentum created thereby between point of attachment and pivot point—seek to maintain a fixed orientation relative to the ice/current or wind that influences the vessel.

By positioning the opening in the vessel and there below, the anchor line is furthermore located in closer proximity to the natural pivot point of the vessel, and thereby it is accomplished that the above-referenced momentum is minimized whereby it becomes easier to freely select a suitable orientation of the vessel, while the latter—under the influence of the forces from the anchor—is moved through the ice, transversally to the direction of movement thereof and across the bed of the water under the influence of the ice.

According to an embodiment of the vessel, the opening through which the anchor line travels into the water is arranged—substantially—halfway between the midpoint of the vessel (ie the midpoint of the vessel in the longitudinal direction thereof, which is also designated the midship point) and the stern of the vessel.

Positioning of the opening in that place means that the vessel needs less fuel for manoeuvring, while simultaneously a sufficiently straightening momentum is maintained between the opening and the natural pivot point of the vessel.

In this embodiment, the vessel may thus be moved across a surface area of the water without the ice influencing the anchor line and without the need for inexpediently much energy for maintaining a course/orientation which is favourable for icebreaking.

In practice, the ice also changes direction, and often no one will know in advance which direction it will change into. Therefore, the vessel may be equipped to deploy two or more anchors. Thereby, the vessel may use to advantage the one or the other anchor line for icebreaking. Of course, according to such embodiment, the vessel may also use the pull from two or more anchor lines for icebreaking and, likewise, the anchor handling winches may—by suitable deployment of several anchors—be utilised as powering means for moving the vessel transversally to the direction of movement of the ice.

According to one embodiment of the invention, the vessel has two openings arranged below the water line, and both between the midship point of the vessel (which, as explained above is the centre of the vessel) and the stern.

According to one embodiment of the invention, the vessel has two openings arranged below the water line and both between the midship point of the vessel and the bow.

According to one embodiment, an icebreaking supply vessel with one or two azimuth propellers is used, ie propellers that can be rotated 360° about an essentially vertical axis. Usually, the vessel has lateral propellers, too, but they play a minor part compared to the azimuth propellers, in particular when it is the heel that is made to face towards the ice. Thereby the azimuth propellers may, on the one hand, grind the ice and, on the other, push the ice chunks away along with the propeller water.

When the heel is disposed against the ice, the anchor handling winch can be used to pull the vessel upwards against the movement of the ice to the effect that machine power is used only to grind the ice and to push the ice around the drilling vessel.

By using vessels according to the invention, a larger number of vessels can be anchored and operate quite closely to the drilling platform without an ensuring risk of them colliding. Thereby the water around the drilling vessel can be kept free of ice in a particularly efficient manner, and much money can be saved on ice-doublings of the drilling vessel.

Embodiments of the invention will be set forth in the dependent claims.

The invention also relates to a method as set forth in claim 18.

The text mentions the use of azimuth propellers; of course, they can also be other means providing motive force/thrusters/propellers known to the person skilled in the art.

By the phrase "expanse of the vessel" is intended the area comprised by:

the largest length of the vessel, and the largest width of the vessel.

The largest length and the largest width of the vessel are also designated: L.O.A.

The invention will now be explained in further detail with reference to a number of embodiments, reference being made to the drawing, wherein:

FIG. 3 shows an alternative embodiment of a method for icebreaking within a given area; while FIG. 4 shows yet an embodiment; while

Figure 1:
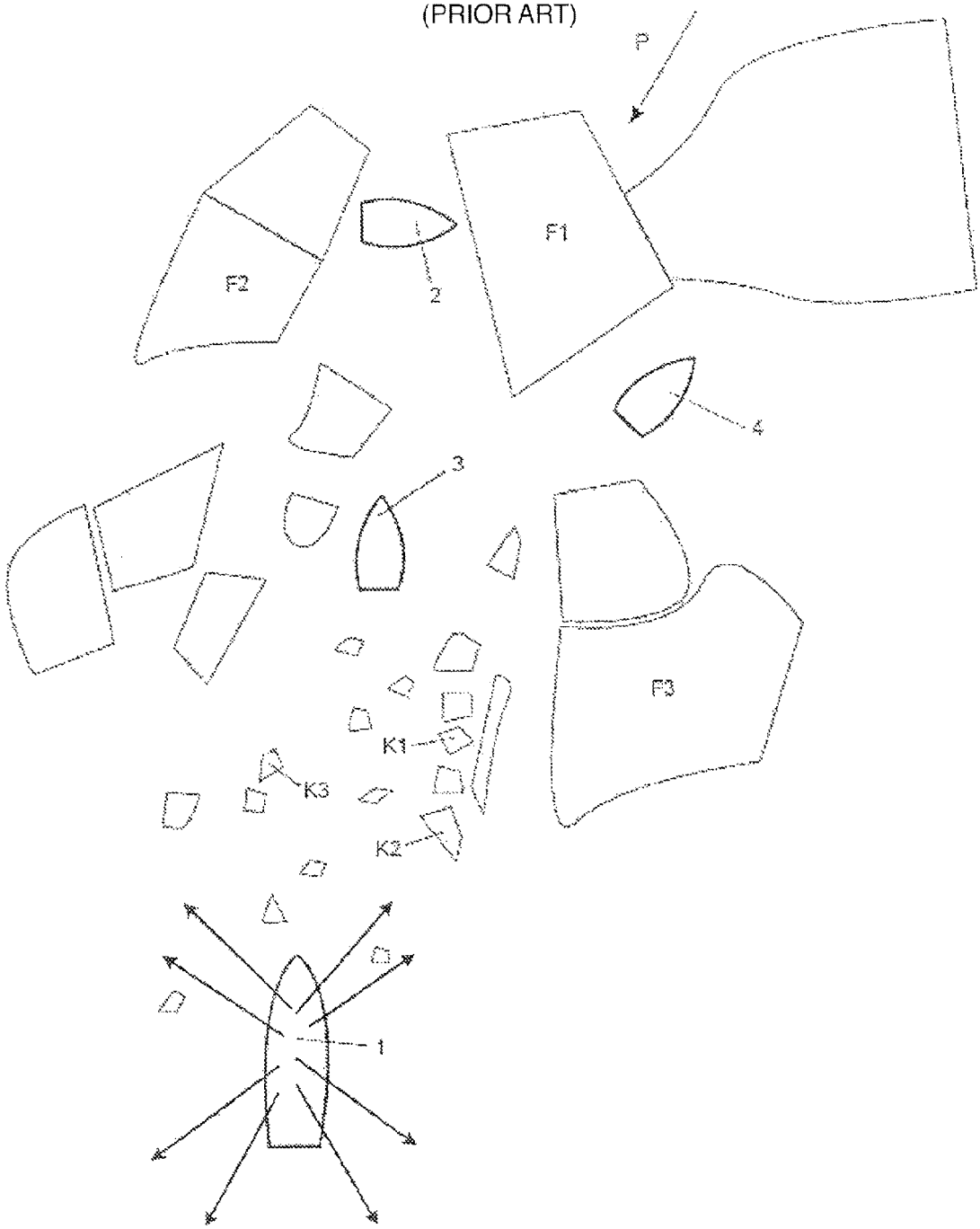
Fig. 1 (PRIOR ART)
FIG. 1 illustrates the prior art.

FIG. 1 shows a drilling vessel 1 in Arctic waters. The drilling vessel is retained by means of eg eight anchors. The associated anchor lines are illustrated by means of the eight arrows in the figure. FIG. 1 also shows a number of large ice floes F1, F2 and F3 that are broken by means of icebreakers 2, 3 and 4 to the effect that only relatively few and small chunks of ice K1, K2 and K3 drift along and past the drilling vessel, since the ice drifts in the direction of the shown arrow P. If an ice floe the size of floes F1, F2 or F3 hits the drilling vessel, the anchors thereof cannot uphold the requisite, exact position.

Icebreakers 2, 3 and 4 are in mutual communication with one another to obtain the most efficient icebreaking possible. However, this does not prevent the energy consumption onboard the three vessels to be high, see the explanation of this in the introduction. The invention entails a considerable reduction in the consumption of resources necessary for breaking the ice sufficiently.

Figure 2:
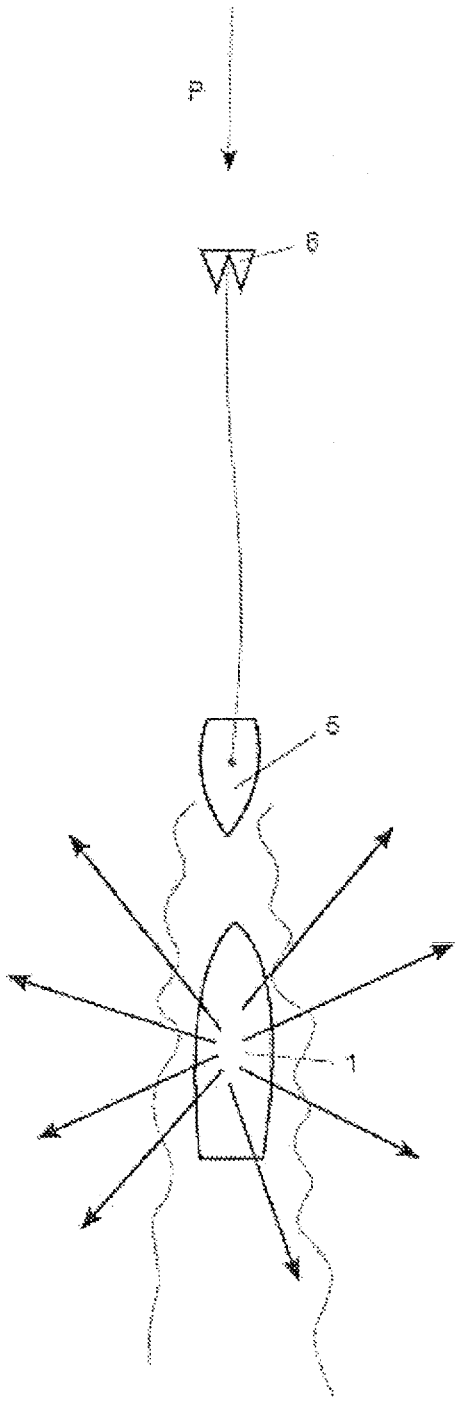
FIG. 2 shows an embodiment of a method for ice management.

FIG. 2 illustrates a method whereby a vessel 5, eg an ice-breaking supply vessel, goes sailing and sets an anchor 6 to the effect that the vessel 5 will go in the direction of the drilling vessel 1 when the anchor line is deployed. The anchor line may typically have a length of 1000 m (depending on the depth of water, but typically it is three times the depth of water). The ice moves essentially in the direction of the arrow P, but for the sake of overview it is not shown in FIG. 2.

The mere fact that the vessel 5 is still without active motive-power machinery will entail that the ice which is moving towards the drilling vessel 1 is broken. It will appear from the figure that the vessel turns the heel towards the ice, and by means of a pair of fixed propellers, it is easy to turn the vessel relative to the direction of movement of the ice (see below) and to thereby use to advantage the pressure exerted by the ice to shift the vessel 5 transversally of the direction of movement of the ice. In certain conditions, one single vessel operating in this manner suffices for protecting the drilling vessel 1.

Figure 3:
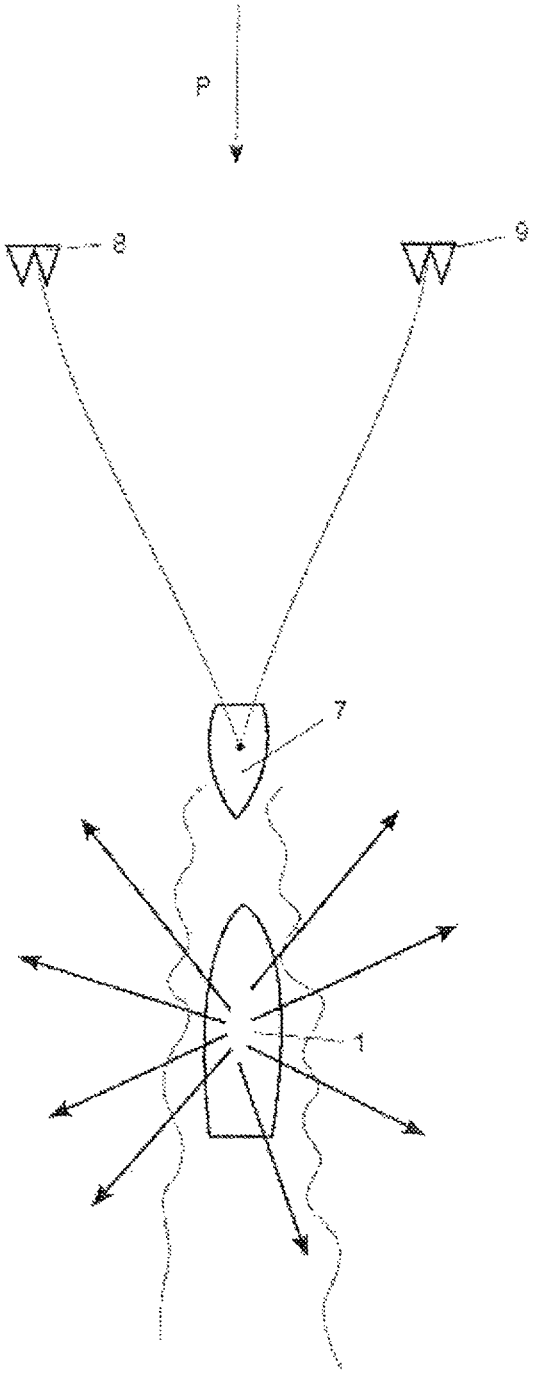

FIG. 3 shows an alternative or a supplementary method for shifting the vessel 7 in the transverse direction to the effect that a sufficiently wide belt is provided where the ice is rendered harmless. This is done by deployment of two anchors 8 and 9 and by utilizing the anchor handling winches of the respective anchor lines to balance the forces in and the lengths of the anchor lines to the effect that such measure contributes to controlling the position of the vessel. By simultaneous use of propellers, the captain has many options for breaking the ice optimally.

According to one embodiment one (or more) icebreaking supply vessel(s) is (are) used that are provided with an azimuth propeller at both sides in the stern of the vessel. Those propellers that can be rotated 360° are particularly efficient for use in the exercise of the method according to the invention. When the anchor line holds the vessel up against the pressure of the ice, the propellers can be set in a transverse position to the effect that they both press the one side of the vessel towards the ice, the propeller close to the ice crushing it, while the other disposes of the ice with the propeller water.

Figure 4:
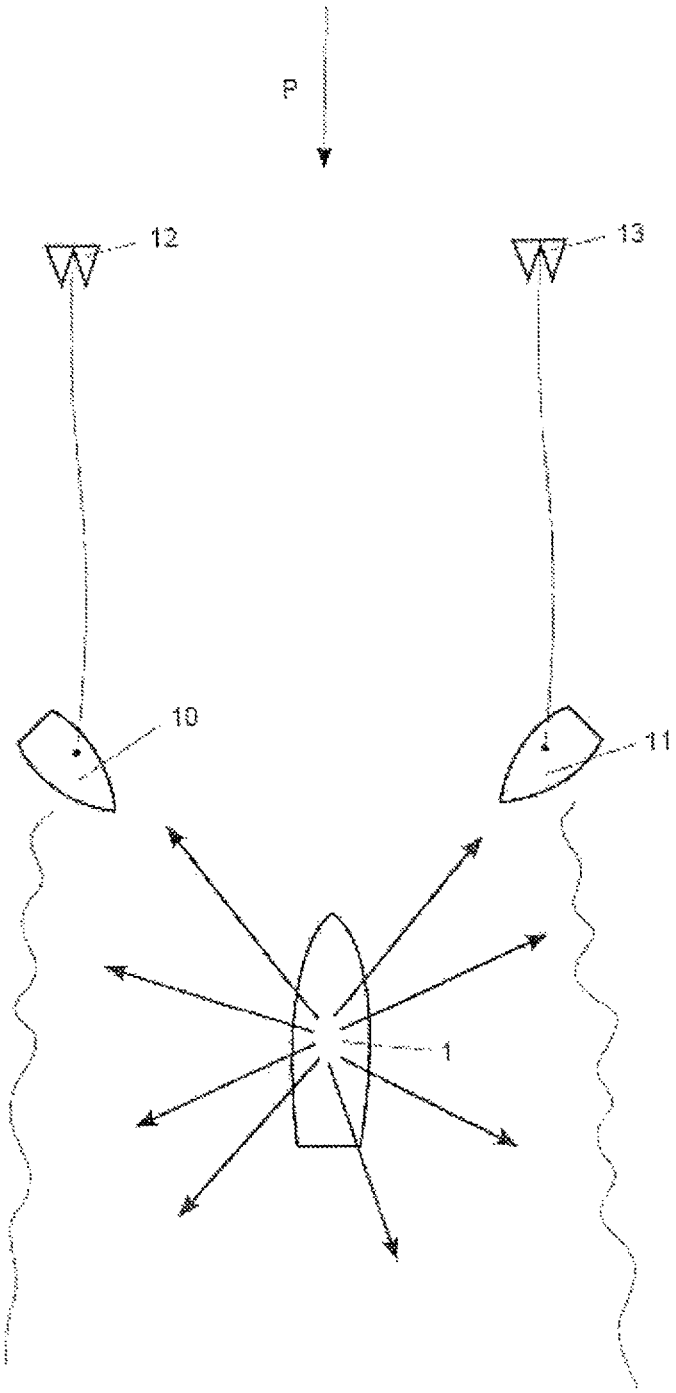

FIG. 4 shows a further, alternative embodiment, wherein two supply vessels 10, 11 are used that are anchored by each their anchor 12 and 13, respectively. In this way, the width of the belt where the ice has been rendered harmless is widened, and it is noted that it is possible to situate the vessels 10, 11 fairly close to the drilling vessel 1 without an ensuing risk of them colliding with each other as the very large forces in the direction of movement of the ice are absorbed by the respective anchor lines which are essentially parallel.

Figure 5:
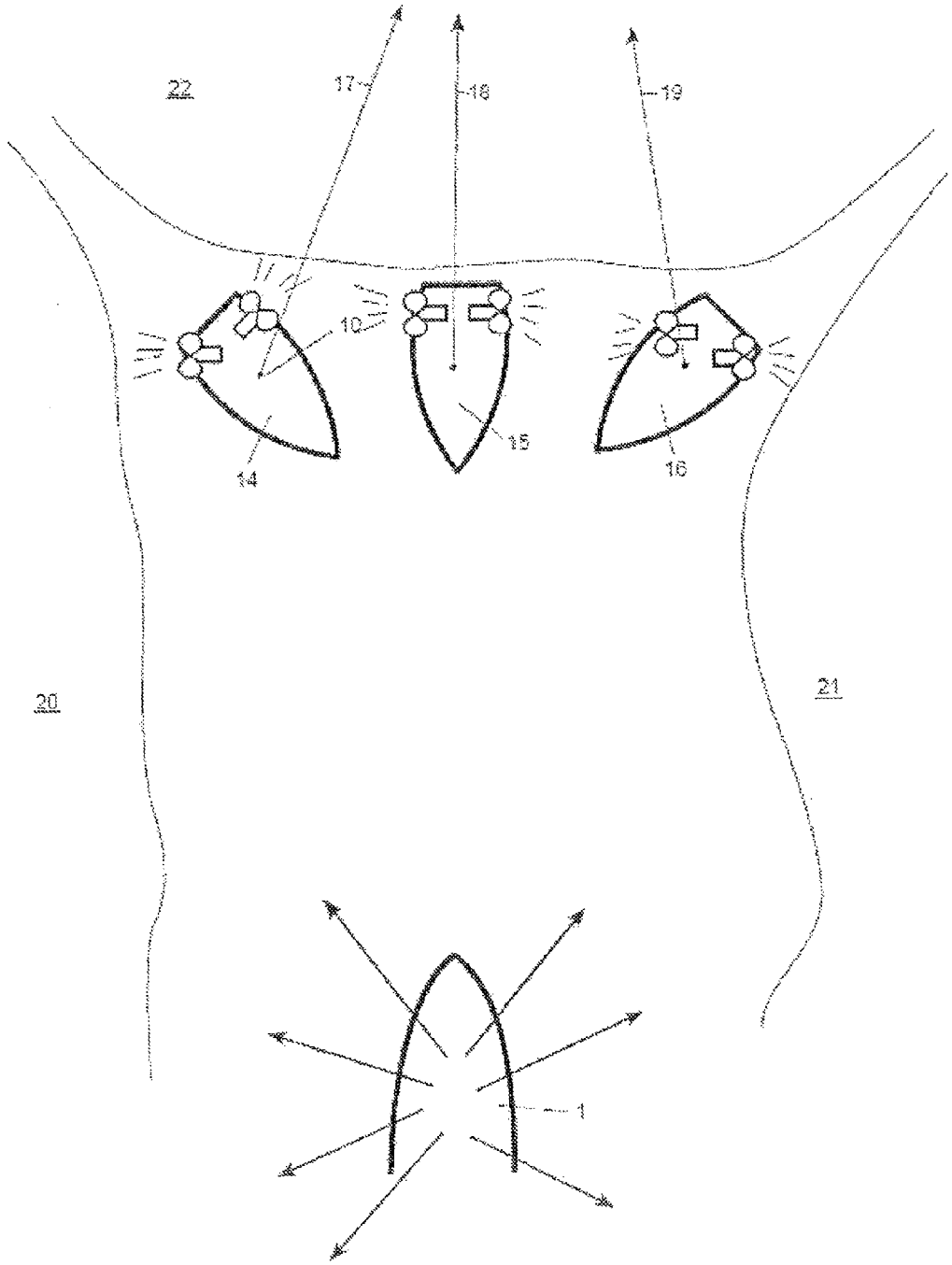
FIG. 5 illustrates ice management with three vessels.

FIG. 5 illustrates ice management by means of a method.

The drilling vessel is still shown by 1, but now three icebreaking supply vessels 14, 15 and 16 are used that are anchored by means of respective anchor lines 17, 18 and 19, respectively. The figure also shows three large floes of ice 20, 21 and 22. The small chunks of ice are not shown. They were crushed by the six azimuth propellers of the three vessels to a size which is harmless for the drilling vessel 1.

The middle vessel is retained by its anchor line 18 and grinds ice off the ice floe 22 which is pushed away by the propeller water. The outermost vessels 14 and 16 also machine the ice floe 22 simultaneously with the floes 20 and 21 being pushed to each their side, around the drilling vessel 1. In this manner, the water around the drilling vessel can be kept free from ice to such degree that it is not necessary to ice-double the drilling vessel significantly. Thereby further economies can be obtained by the method according to the invention in addition to the great economies obtained on fuel and the ensuing reduction of pollution.

Of course, it is common that the direction of the current/the ice changes. It may therefore also be necessary to move anchors and vessels to continuously eliminate ice and/or render ice harmless around an off-shore installation. In order to monitor the movement of the ice, it is an option to deploy, in an area around the off-shore installation, one or more GPS apparatuses (loggers)—known per se—on the ice. Thus, by means of the GPS apparatuses, it is possible to monitor the movement of the ice around the off-shore installation and to obtain a (an early) warning of substantial changes to the direction of movement of the ice. Thereby it is also possible to issue a warning about and to implement movement of anchors in due time to the effect that it is possible to continuously render the ice harmless (or to keep the sea completely free from ice) around the off-shore installation.

Figure 6:
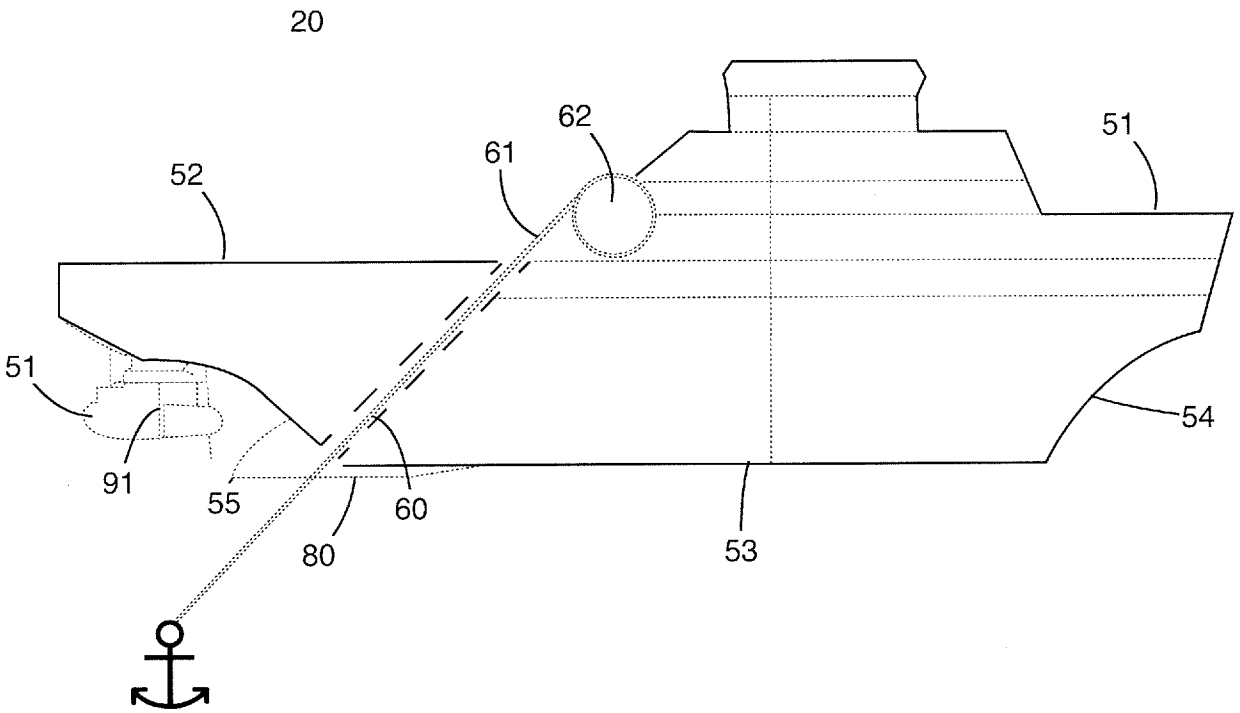
FIG. 6 shows an embodiment of a vessel according to the invention.

FIG. 6 is a schematic sectional view of an embodiment of a vessel according to the invention.

The vessel comprises a bow (51) and a stern (52), both of which are configured with an icebreaking portion (54, 55). They are separated by and are situated above the most deeply situated part of the vessel which—in the embodiment shown, is the so-called flat bottom (53)—in the horizontal plane.

In the stern of the vessel, an internal passage (60) is shown which—in the embodiment shown—contains an anchor line 61. At the one end, the anchor line is wound around an anchor handling winch/wheel (62) and, at the other end, it is attached to an anchor (not shown). According to one embodiment of the invention, the opening through which the anchor line passes out into the water is located as far towards the stern as possible in the flat bottom of the vessel. As far towards the stern as possible usually means so far towards the stern that the opening is caused to be further up than the horizontal plane of the flat bottom.

This text uses the term anchor handling winch/wheel which is different from a conventional capstan in that it is usually designed for far greater forces than conventional capstans. Thus, an anchor handling winch may exert pulls of 600-1000 tons (corresponding to about 6,000,000-10,000,000 Newton) and have a braking power of 1,000-1,500 tons (corresponding to about 10,000,000-15,000,000 Newton).

The vessel comprises one or more thruster(s) (50) arranged in the stern of the vessel (52.) In the shown embodiment, the thruster is journalled rotatably about an axis (90). Of course, vessel and thruster(s) may also be made such that one or more thruster (s) is (are) not rotatable.

For the sake of stability as well as performance, the thrusters of the vessel are arranged such that the propellers are located above the horizontal plane of the flat bottom. It is realised by the invention that an anchor line can be conveyed out through that part of the bottom which is below the vessel's propellers (thrusters) without the line thereby coming into contact with the vessel's stern propellers (thrusters).

Figure 7:
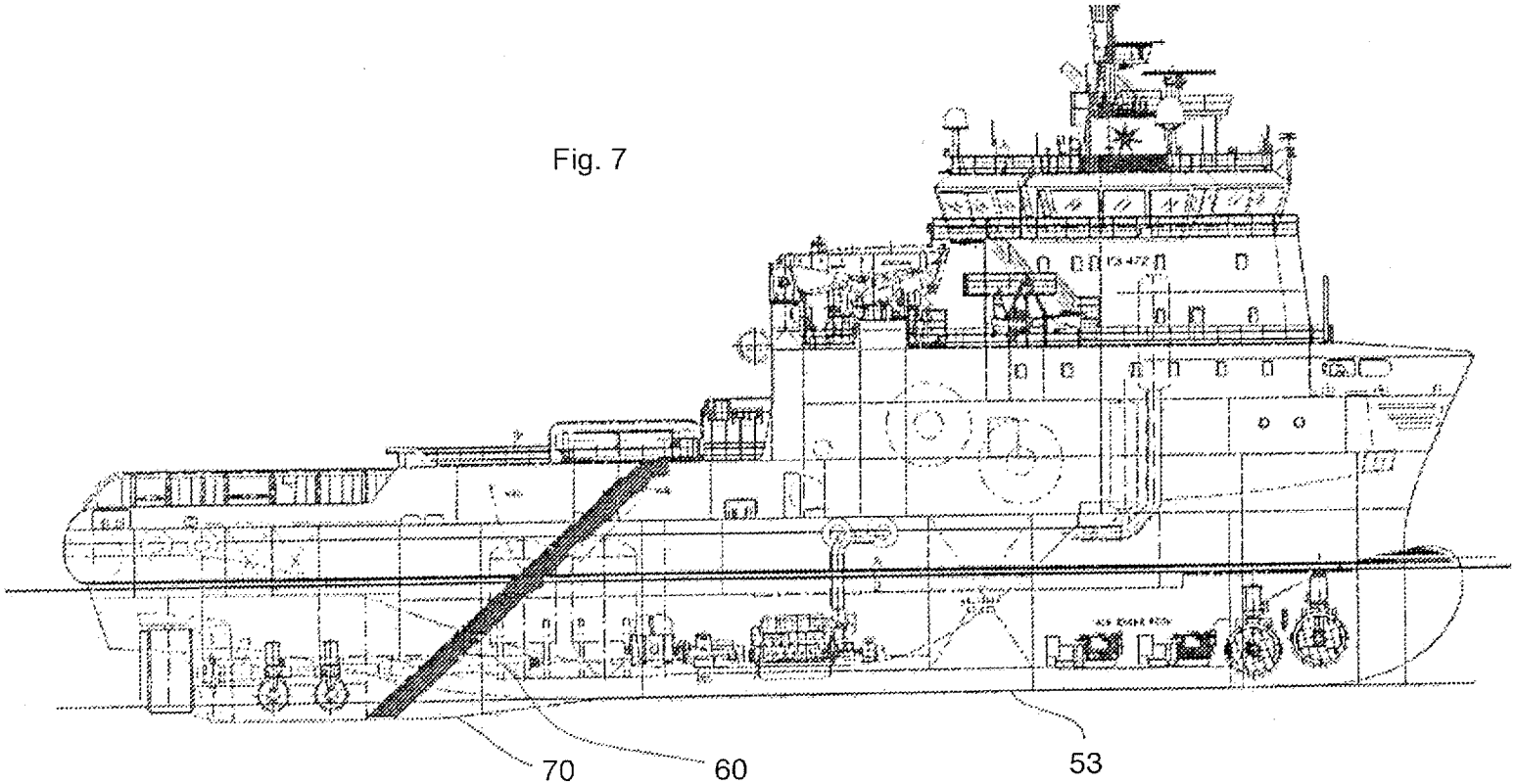
FIG. 7 shows an embodiment of the invention executed on a vessel comprising a so-called "skeg"

FIG. 7 shows an embodiment of the invention executed on a vessel comprising a so-called "skeg" (70), whose functionality will be described in the following.

For the sake of good order, it should be mentioned initially that the vessel depicted in FIG. 7 is actually not an icebreaker, and that the depiction serves to explain the functionality of a "skeg".

To increase the performance of the stern propellers of an icebreaking vessel, they are, in a corresponding manner (as shown in FIG. 7), sometimes arranged such that a part of the propellers or their blades go deeper into the water than the flat bottom (60) of the vessel. Such vessels are often made with a lowered bottom part called the skeg. The skeg is situated in front (seen relative to the normal direction of sailing of the vessel). The purpose of a skeg is to protect the propellers in shallow waters since "the skeg" will prevent the propellers from hitting the bottom in case of a grounding, if any.

An actual icebreaking vessel can thus be made with "skeg" as shown in FIG. 7, and in such vessels the invention can be executed by allowing the anchor line to pass into the water from a point in "the skeg" that is situated below (deeper than) the vessel's propellers (thrusters).

Hereby it will be obvious to the person having skills within this art that a vessel with an icebreaking hull can be provided with a skeg. It is thus also possible to configure it with a passage for anchor line, wherein the opening conveying the anchor line into the water is arranged in "the skeg" and, more specifically, also to the rear thereof (towards the stern), as shown in FIG. 7. Also with the modifications that are within the ordinary skills of the person skilled in the art.

Figure 8:
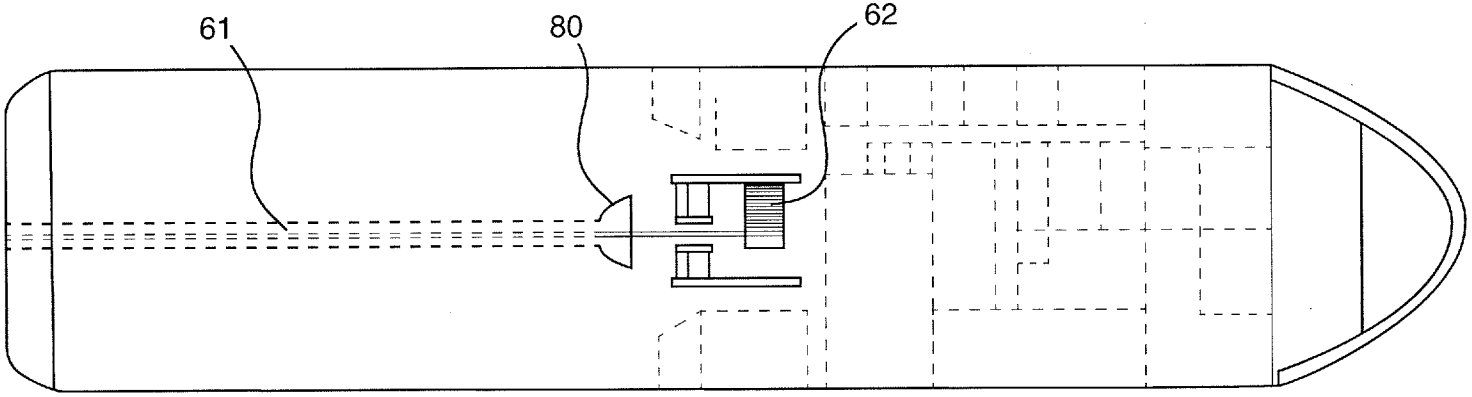
FIG. 8 shows a vessel as shown in FIG. 6, seen from above.
Figure 9:
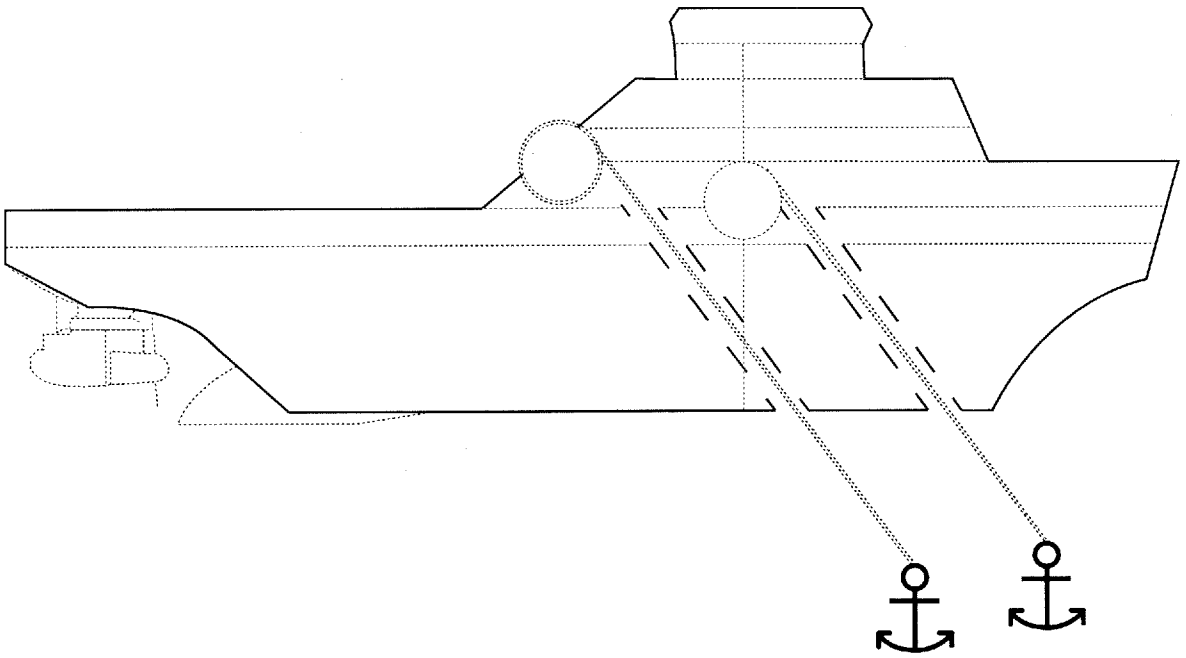
FIG. 9 illustrates an embodiment of a vessel that includes two openings arranged between a midship point of the vessel and a bow of the vessel.
Figure 10:
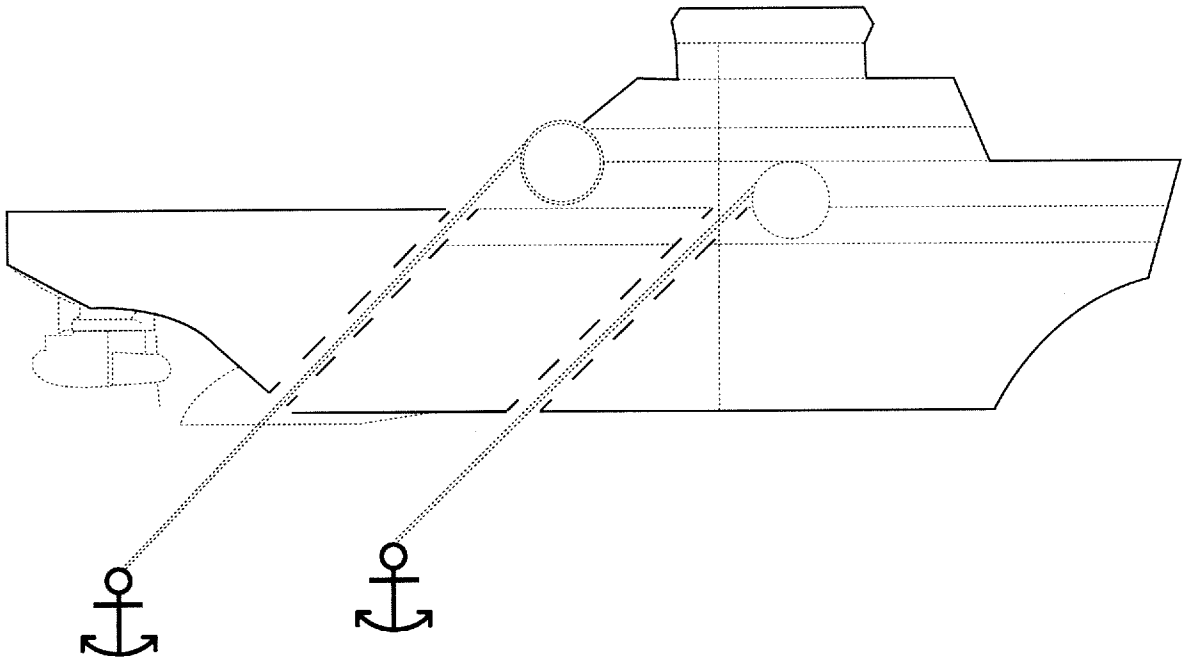
FIG. 10 illustrates an embodiment of a vessel that includes two openings arranged between a midship point of the vessel and a stern of the vessel.

FIG. 8 shows a vessel as shown in FIG. 6, seen from above. Centrally of the vessel, an anchor handling winch (62) is shown which is coupled to an anchor (not shown) via an anchor line (61) extending via an internal passage (outlined behind the funnel) and further out through an opening (not shown either) in the bottom of the vessel.

As will appear from FIG. 8, the anchor line extends from the anchor handling winch into a funnel-like part (80). The purpose of that part (80) is to convey the anchor line from the winch and into the internal passage (shown in dotted lines) which extends through the vessel and out through the bottom thereof. The shape of the funnel-like part may of course be varied within the ordinary skills of the person skilled in this art; the essential aspect being that the funnel-like part is capable of capturing the anchor line from the entire width of the anchor handling winch and of conveying it into the internal passage of the vessel.

Other aspects of the invention are:

According to a first aspect of the invention, it is a method in the breaking of ice drifting with a predominant direction relative to an off-shore installation, characterized in that, by means of a vessel, an anchor is deployed in a position at a distance from the off-shore installation and in a direction with is, as seen from the off-shore installation, substantially in parallel with the direction of movement of the ice; and that the machinery of the vessel is used to adjust the direction of the anchor line.

According to a second aspect of the invention, it is a method like in the first embodiment, characterized in that a vessel is used, wherein the machinery comprises one or more azimuth propellers.

According to a third aspect of the invention, it is a method like in the first or the second aspect, characterized in that a vessel is used, wherein the machinery comprises side propellers.

According to a fourth aspect of the invention, it is a method like in the first to third aspects, characterized in that the machinery is used to adjust the direction of the vessel relative to the direction of the anchor line.

According to a fifth aspect of the invention, it is a method like in the first to fourth aspects, characterized in that the vessel is turned such that the heel is facing towards the ice.

According to a sixth aspect of the invention, it is a method like in the fifth aspect, characterized in that the anchor handling winch is used to pull the heel of the vessel upwards against the ice.

According to a seventh aspect of the invention, it is a method like in the first aspect, characterized in that several anchors are deployed in dissimilar directions relative to the off-shore installation.

According to an eighth aspect of the invention, it is a method like in the first to seventh aspects, wherein a number of GPS apparatuses are deployed on the ice, upstream of and at a distance from the off-shore installation, characterized in that information received from then GPS apparatuses are used to detect a change in the direction of movement of the ice; and that this information is used to decide whether one or more anchors are to be moved. Any of these aspects can be combined with the invention as set forth according to claim any of the claims.

The invention claimed is:

1. A vessel with an icebreaking hull to eliminate ice or to render ice harmless in a surface area of water in proximity of an off-shore installation, said vessel comprising:

an anchor configured to be deployed in an anchor line at a distance from the vessel;

motive force means that provide power for moving the vessel while it is anchored;

an anchor handling winch configured to wind or unwind the anchor line through a substantially straight internal passage that extends from a first opening in the vessel arranged below the motive force means and between a mid section of the vessel and one of a bow and a stern of the vessel through to a second opening arranged in a top most deck of the vessel, wherein the hull is a mono hull and the first opening is arranged in a flat portion defined on bottom of the hull;

wherein the bow and the stern of the vessel are equipped with a portion configured to break ice upon contact with the portion so that the vessel is capable of performing icebreaking tasks while it is anchored, said vessel being, by the motive force means or the anchor handling winch, movable across a surface area of the bed of the sea, which has a significantly larger expanse than the expanse of the vessel, while anchored, whereby the vessel is capable of eliminating or rendering the ice harmless in a surface area of the sea.

2. The vessel according to claim 1, wherein the first opening is arranged in proximity of the point around which the vessel will pivot naturally.

3. The vessel according to claim 1, wherein the first opening is arranged as far towards a stern in the bottom of the vessel as possible without the opening coming first higher up than the horizontal plane of the vessel bottom.

4. The vessel according to claim 1, wherein the first opening is arranged as far towards the stern in the vessel as possible without the first opening coming higher up than the lowermost part of a propeller periphery.

5. The vessel according to claim 1, wherein the first opening is arranged as far towards the stern in a flat bottom of the vessel as possible.

6. The vessel according to claim 1, wherein the opening is arranged in a skeg of the vessel.

7. The vessel according to claim 1, wherein the first opening is arranged as far towards the stern in a skeg of the vessel as possible.

8. The vessel according to claim 1, wherein the first opening is arranged as far towards the stern in a vessel skeg as possible without the first opening coming higher up than the lowermost part of a propeller periphery.

9. The vessel according to claim 1, wherein the first opening through which the anchor line passes into the water is arranged substantially halfway between the midship point of the vessel and the stern of the vessel.

10. The vessel according to claim 1, wherein the first opening through which the anchor line passes into the water is arranged substantially halfway between the midship point of the vessel and the bow of the vessel.

11. The vessel according to claim 1, wherein the first opening further comprises two openings through which anchor lines may pass into the water; and that both the openings are arranged below the water line of the vessel and between the midship point of the vessel and the stern.

12. The vessel according to claim 1, wherein the first opening further comprises two openings through which anchor lines may pass into the water; and in that both the openings are arranged under the water line of the vessel and between the midship point of the vessel the and bow.

13. A Method for breaking ice in proximity of an off-shore installation, comprising:

providing a vessel that includes:

an anchor which can be deployed in an anchor line at a distance from the vessel;

an anchor handling winch configured to wind or unwind the anchor line through a substantially straight internal passage that extends from a first opening in the vessel arranged below a motive force means and between a mid section of the vessel and one of a bow and a stern of the vessel through to a second opening arranged in a top most deck of the vessel, wherein the hull is a mono hull and the first opening is arranged in a flat portion defined on a bottom of the hull;

motive force means the provide power for moving the vessel while it is anchored, wherein the bow and the stern of the vessel are equipped with a portion configured to break ice upon contact with the portion so that the vessel is capable of performing icebreaking tasks while it is anchored, said vessel being movable across a surface area of the bed of the sea, which has a significantly larger expanse than the expanse of the vessel, while anchored, whereby the vessel is capable of eliminating or rendering the ice harmless in a surface area of the sea;

positioning the vessel at a distance from the off-shore installation and in a direction which, as seen from the off-shore installation, is substantially in parallel with the direction of movement of the ice to the effect that the vessel is capable of breaking ice drifting towards the off-shore installation, deploying the anchor in the anchor line which is conveyed through the internal passage in the vessel and out through the opening which is arranged under the sea level, positioning the vessel such that a holding force of the anchor can be transferred from the anchor to the vessel via the anchor line and the anchor handling winch, adjusting the direction of the anchor line and/or its length via machinery and/or the anchor handling winch of the vessel to the effect that the vessel can be moved across a surface area of the sea bed which has a considerably larger expanse than the expanse of the vessel, whereby the vessel is capable of eliminating ice and/or rendering ice harmless in a surface area of the water.

14. The method according to claim 13, wherein the first opening is arranged in proximity of the point around which the vessel will pivot naturally.

15. The method according to claim 13, wherein the first opening is arranged as far towards a stern in the bottom of the vessel as possible without the opening coming first higher up than the horizontal plane of the vessel bottom.

* * * * *